US009045922B2

(12) United States Patent
Fortmann

(10) Patent No.: US 9,045,922 B2
(45) Date of Patent: Jun. 2, 2015

(54) HINGED SURFACE CHOCK DEPLOYMENT AND STOWAGE ENABLING APPARATUS AND METHOD

(71) Applicant: Marina Yurii Fortmann, Peoria, IL (US)

(72) Inventor: Marina Yurii Fortmann, Peoria, IL (US)

( * ) Notice: Subject to any disclaimer, the term of this patent is extended or adjusted under 35 U.S.C. 154(b) by 0 days.

(21) Appl. No.: 14/056,941

(22) Filed: Oct. 18, 2013

(65) Prior Publication Data

US 2015/0108774 A1 Apr. 23, 2015

(51) Int. Cl.
*E05C 17/44* (2006.01)
*E05C 19/00* (2006.01)

(52) U.S. Cl.
CPC ..... *E05C 19/007* (2013.01)

(58) Field of Classification Search
USPC ..... 292/342, DIG. 15
See application file for complete search history.

(56) References Cited

U.S. PATENT DOCUMENTS 1,616,265 A * 2/1927 Kroehling ..... 16/375
3,137,025 A * 6/1964 Howard ..... 16/83
3,325,854 A * 6/1967 Steigerwald ..... 16/375
3,425,386 A * 2/1969 Campbell ..... 116/87
4,527,303 A * 7/1985 Civitelli ..... 16/86 B
4,648,152 A * 3/1987 Grewall ..... 16/82
5,237,724 A * 8/1993 Lee ..... 16/375
5,509,235 A * 4/1996 Chander ..... 49/383
5,711,557 A * 1/1998 Nicolosi ..... 292/288
6,003,911 A * 12/1999 Sowash ..... 292/343
7,234,202 B2 * 6/2007 Li ..... 16/82
7,374,213 B2 * 5/2008 Carlson ..... 292/343
8,595,899 B2 * 12/2013 McRoskey et al. ..... 16/83

* cited by examiner

*Primary Examiner* — Mark Williams
(74) *Attorney, Agent, or Firm* — Hamilton IP Law, PC; Jay R. Hamilton; Charles A. Damschen

(57) ABSTRACT

A mechanism or apparatus enables stowing a hinged surface chock at a stowage position near a deployment position. Said stowage and deployment positions separated by a gap between a first hinged surface and a second hinged surface, where said hinged surfaces are attached by at least one hinge. The apparatus enables the transition of said chock through said gap when one of said hinged surfaces is sufficiently open. Said apparatus will enable stowing said chock by holding said chock at the side of the gap where said chock does not obstruct the closing path of either hinged surface and said apparatus will enable deploying said chock by holding said chock where, at least partially, said chock obstructs the closing path of at least one of said hinged surfaces. Said apparatus may further enable arranging said chock at a wider angle at the deployed position.

19 Claims, 13 Drawing Sheets

HINGED SURFACE CHOCK DEPLOYMENT AND STOWAGE ENABLING APPARATUS AND METHOD

CROSS-REFERENCE TO RELATED APPLICATIONS

Not applicable.

BACKGROUND

1. Field of Invention

This invention relates to hinged surface propping apparatuses, specifically to mechanisms and methods which allow deploying a hinged surface chock from a stowed position to a position of use, or deployed position, and inversely, retracting such said chock from a deployed position to a stowed position.

2. Description of Prior Art

A number of door propping mechanisms are available; the most commonly used types are a wedge-shaped part that is inserted at a door bottom, or a "kick-down" arm attached to a door bottom which can be lowered to keep a door open, and retracted when not in use.

Although the kick down arm offers the advantage of being easily stowed, it has two main disadvantages: it relies on a floor to keep a door open and it is located where at times its use may require bending over.

The wedge type design shares the two disadvantages of the kick down arm, and in addition it is also a loose part which can easily be misplaced.

Interacting with a floor to keep a door open is a problem if the floor covering is slippery, easily damaged, or if the floor at the closing side of the threshold is much lower than the door bottom.

An improvement for a door propping apparatus which interacts with the hinged side of a door and a door jamb is shown in U.S. Pat. No. 83,967 to Howell (1868). The door propping apparatus described by Howell overcomes some of the limitations mentioned above but shares a disadvantage with the wedge type design in that it is a loose part.

Howell recognizes the disadvantage of his invention and proposes securing it with a chain or cord, an inelegant solution which trades the disadvantage of a loose component for the disadvantages of dangling part; he thus rightly refers to his invention as a portable device.

Several door propping apparatuses similar to the one described by Howell have been patented (U.S. Pat. No. 4,831,688 to Deininger (1989), U.S. Pat. No. 5,027,471 to Barnes (1991), U.S. Pat. No. 5,450,652 to Webb (1995), U.S. Pat. No. 5,873,146 to Mungo (1999), U.S. Pat. No. 7,559,114 to Ranilovich (2009)). These devices are sometimes referred to as "door chocks" and are either explicitly defined as portable or somehow termed removable.

Howell extends the use of his invention to also include propping shutters open, yet narrowly names his invention a "retaining-device for doors". Simple modifications to his and related inventions would enable their use on other hinged surfaces. Hereinafter the terms "hinged surface chock", or simply "chock", will be used to refer to an apparatus which obstructs the closing path of a hinged surface in the vicinity of a gap between said hinged surface and another hinged surface connected to it by at least one hinge.

My invention expands the usefulness of hinged surface chocks by enabling their use as non-portable devices. My invention is not a chock, but a mechanism to enable deployment and stowage of these and similar apparatuses. Limited prior art for inventions that enable stowage of a hinged surface chock (Howell's cord suggestion, US patent application 20120043770 by Wong (2012) showing a hook for hanging a door chock) should attest to its non-obviousness.

SUMMARY OF THE INVENTION

In accordance with the present invention, an apparatus enables stowing a hinged surface chock close to a deployment position, thus improving on the comfort of using a chock. The apparatus of the invention enables stowage of a chock by first enabling an adequately designed and arranged chock to transition, from a deployed position, through a gap between two hinged surfaces, and then holding said chock at a stowage position. The chock can then remain stowed until needed, where then the apparatus of the invention would enable the opposite transition through said gap and into said deployment position between said two hinged surfaces.

DRAWING FIGURES

In the drawings, for figures with the same number, a different alphabetic suffix represents a different arrangement of: a part of an embodiment of the invention, something that interacts with an embodiment or a combination of these. The same alphabetic suffix is used for equivalent arrangements across figures.

FIGS. 1A to 1C introduce some parts that may interact with the invention in arrangements between a stowage position and a deployment position.

For all drawings, straight lead lines (without arrowheads) are used to point to voids only (example: gaps, slots, openings).

DESCRIPTION OF THE INVENTION

Figure 1A:
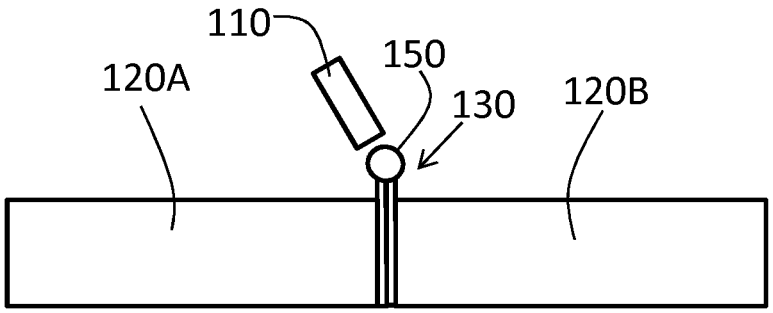
Figure 1B:
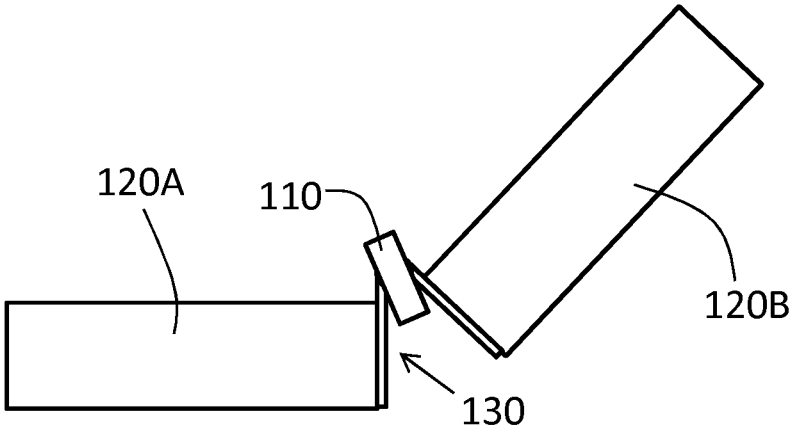
Figure 1C:
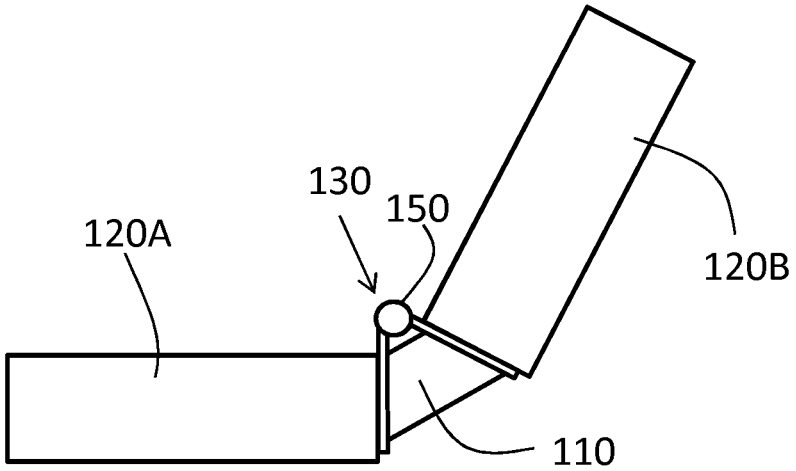

FIGS. 1A, 1B, 1C—Method

FIGS. 1A to 1C (viewed along the axis of rotation of hinge 130, without perspective) are intended to quickly bring a person skilled in the art to an understanding of the general method of operation of the present invention. FIGS. 1A to 1C are also useful in describing parts shown in other figures which interact with select embodiments of the invention but which are not necessarily part of the embodiments. FIGS. 1A to 1C should not be used to limit the invention; other parts not shown in FIGS. 1A to 1C may interact with the invention; certain embodiments of the invention may include, or may be formed-as-one with at least one of the parts shown in FIGS. 1A to 1C. All shapes, proportions and relative sizes are not limiting.

FIG. 1A shows a hinged surface 120A connected through at least one hinge 130 to another hinged surface 120B. It is possible for one of said hinged surfaces to be considered stationary while the other moves (for example, a wall is considered stationary and a door is considered to move) or it is possible that both are considered to move (as in bi-fold doors). For the purpose of this description, and to greatly simplify the text herein, hinged surface 120B will be said to move with respect to hinged surface 120A. Hinged surface 120B, and equivalent surfaces in other figures, should be considered a hinged surface that one desires to keep from closing when deploying a chock.

The relative position of said hinged surfaces is irrelevant, for example, should hinged surface 120A be a back wall of toy chest and 120B a lid of said chest, these hinged surfaces would have a very different arrangement from said hinged surfaces representing a wall and a door. Other parts shown in FIG. 1A may also have a different arrangement, for example, a hinge on a chest would not be fully closed when the chest lid is closed (the wings would usually form close to a 90 degree angle), however, when a door is fully closed this will usually also fully close a hinge attached to said door (the wings of the hinge form close to a 0 degree angle).

Again referring to FIG. 1A, an obstructing apparatus, or chock 110, is shown at a stowage position where it does not prevent closing hinged surface 120B. Said stowage position, at first glance, may appear to be behind knuckle 150 of hinge 130, however the view of FIG. 1A was chosen without perspective because, in fact, said stowage position can be anywhere in vicinity of the gap between hinged surface 120A and hinged surface 120B. Throughout this description a "stowage position", or "stowed position" should be understood as a position as just described.

FIG. 1A shows that an embodiment of the invention enables stowage of said chock at a stowage position.

FIG. 1B shows chock 110 arranged where it will fit through a gap between hinged surfaces 120A and 120B when hinged surface 120B is sufficiently opened. FIG. 1B also shows a transition of chock 110 through said gap and indicates that an embodiment of the invention enables said transition.

It is possible for a chock in an embodiment of the invention to be arranged differently when transitioning from a stowed position to a deployed position and when transitioning in the opposite direction. FIG. 1B is used to represent both transitions because it portrays any arrangement of chock 110 that allows said chock to fit between hinged surfaces 120A and 120B.

For smaller propping angles of hinged surface 120B chock 110 may not require further arrangement once positioned between hinged surfaces 120A and 120B, thus an embodiment of the invention for smaller propping angles would not necessarily enable further arrangement of chock 110.

FIG. 1C shows chock 110 arranged to prop hinged surface 120B at wide angle. An embodiment of the invention for larger propping angles would enable arrangement of chock 110 when positioned between hinged surfaces 120A and 120B so as to keep hinged surface 120B propped at a wide angle.

FIGS. 2, 3, 4

Preferred Embodiment

Figure 2:
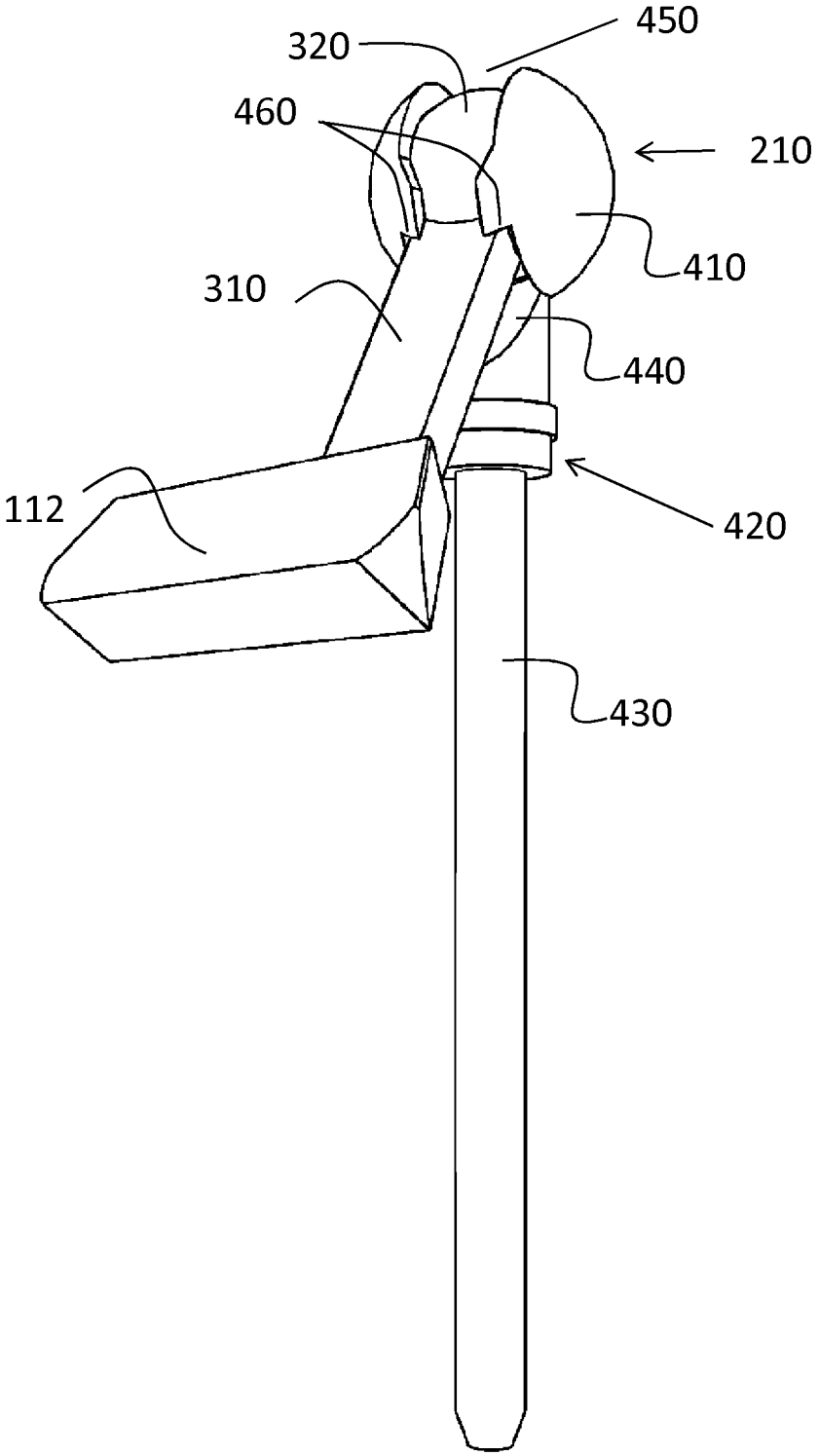
FIG. 2 shows a preferred embodiment of the invention.

FIG. 2 illustrates a preferred embodiment of the invention. A chock equivalent to chock 110 illustrated in FIG. 1A to FIG. 1C is referred to in FIG. 2 as chock 112. The shape, size, material or any other characteristics of a chock are irrelevant to the invention. Also, any chock retracted or deployed by a preferred embodiment, alternative embodiments described or any embodiment which will become apparent to those skilled in the art, is said to be using the invention regardless of how any said variations of a chock are attached to an embodiment or even if any variation of a chock has been formed-as-one to any part of an embodiment of the invention.

Figure 4:
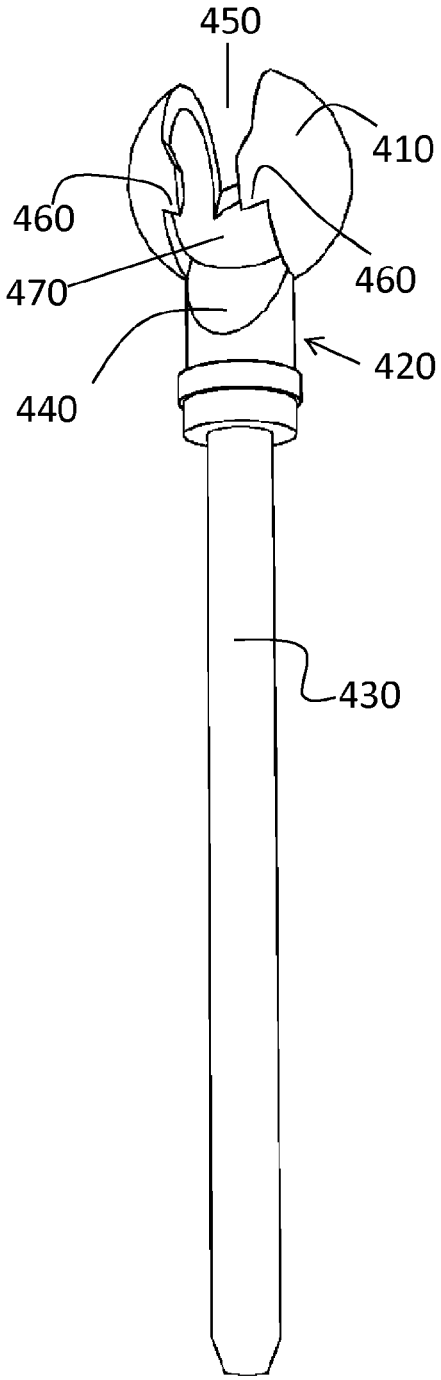

Referring back to FIG. 2, an arm 310 holds chock 112 at one end and is connected to bearing 320 at the other end; said bearing being part of a ball-type joint 210. Said ball-type joint comprises said bearing and a socket 410. Referring to FIG. 4, said socket includes a slot 450 to allow for movement of arm 310 and an opening 470 to enable arranging chock 112 in a wider configuration. Said socket also includes two stops 460.

Referring back to FIG. 2, said socket is attached to a riser 420 shaped with a cutout 440. Said riser and said cutout allow for a steeper angle of arm 310 in a position of deployment. Riser 420 is followed by a pin 430.

Figure 3:
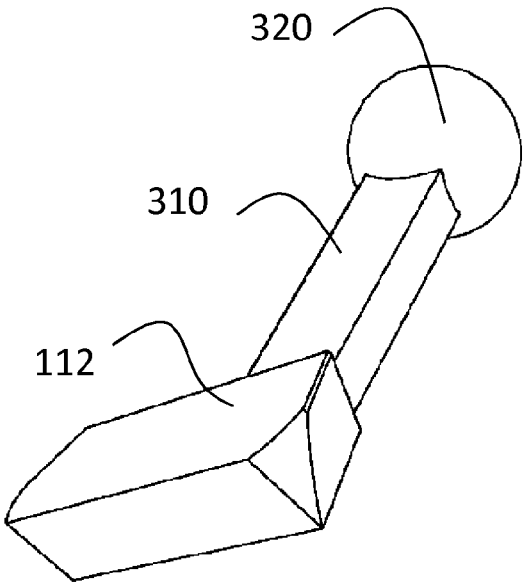
FIG. 3 and FIG. 4 show parts that comprise the embodiment shown in FIG. 2.

FIG. 3 and FIG. 4 show parts that comprise the embodiment. Chock 112 is shown designed to fit this embodiment; this will usually be the case for most embodiments. For ease of manufacture chock 112 may also be formed-as-one with the embodiment (by a casting process, for example). Other components that interact with the invention may be modified to better work with an embodiment of my invention and may also be formed-as-one with the invention; describing all such possible combinations would be endless and unnecessary, as any such additions or modifications do not further clarify the invention.

FIG. 2 shows bearing 320 assembled into socket 410. Ball-type joints are very common assemblies and numerous methods of manufacture are well known to one skilled in the art. For sake of completeness it will be said that socket 410 may be manufactured of a malleable material in an "open" configuration, such that bearing 320 may be first inserted into said socket. Once bearing 320 is in place, socket 410 may be "closed", by applying pressure with a press, into the shape shown in FIG. 2. Other methods will not be described and this single description should not be considered limiting of the scope of the invention.

FIGS. 5A, 5B, 5C

Preferred Embodiment—Operation

Figure 5A:
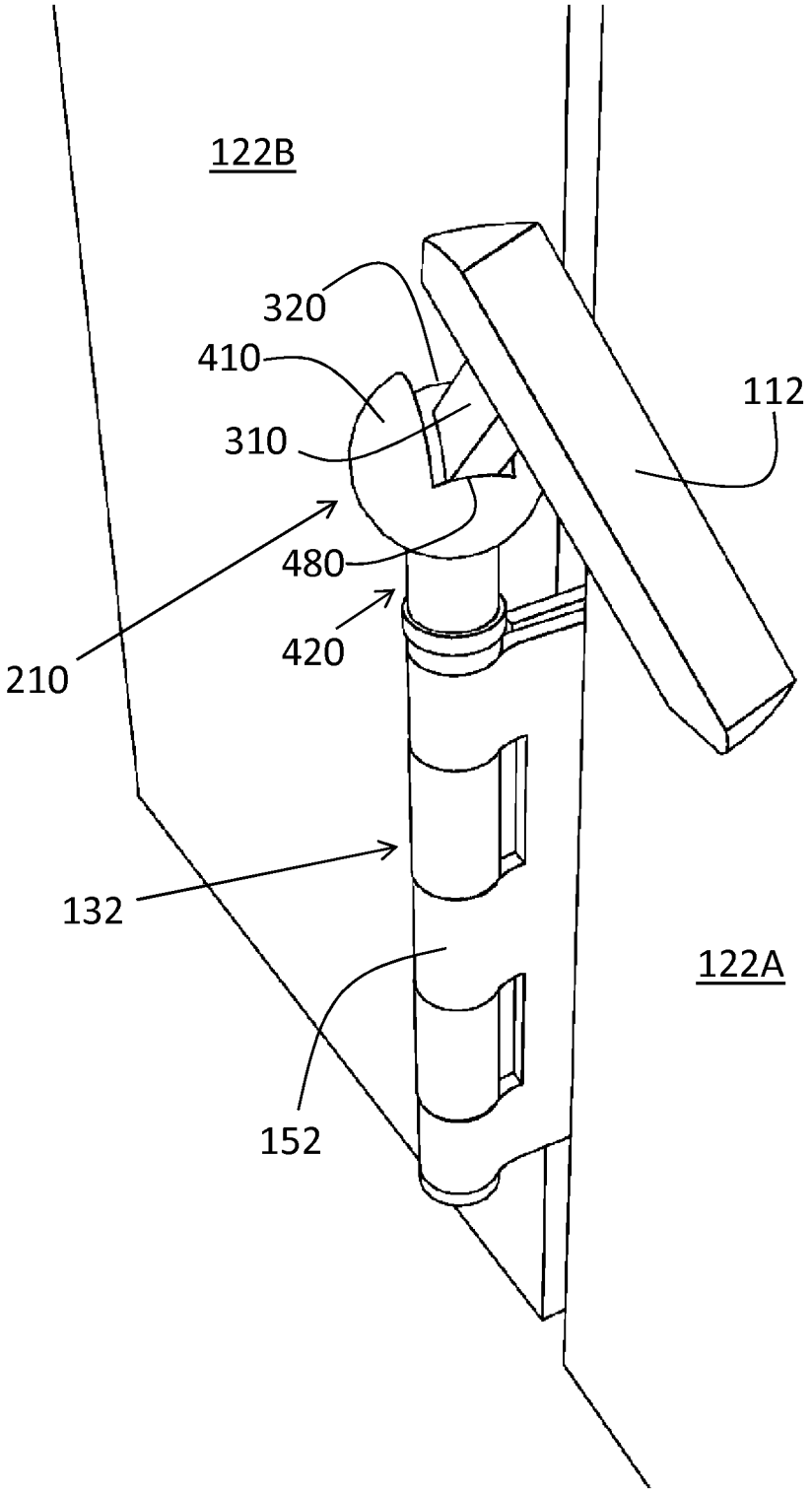
FIGS. 5A to 5C show a preferred embodiment of the invention, and parts that interact with said embodiment, in arrangements between a stowage position and a deployment position.

A preferred embodiment of the invention is shown in FIG. 5A at a stowage position. The arrangement of chock 112 shown in FIG. 5A is comparable to the arrangement of chock 110 shown in FIG. 1A. FIG. 5A also shows a stop 480 limiting movement of arm 310; in this manner chock 112 remains reachable through a gap between hinged surface 122A (partially shown and equivalent to hinged surface 120A) and hinged surface 122B (partially shown and equivalent to hinged surface 120B) when hinge 132 is sufficiently open.

Pin 430, shown in FIG. 4, is not visible in FIG. 5A because it replaces the original pin of hinge 132 and is thus hidden within said hinge. This is just one manner by which this embodiment can be attached; other means of attaching this or other embodiments will be readily apparent to one skilled in the art.

Figure 5B:
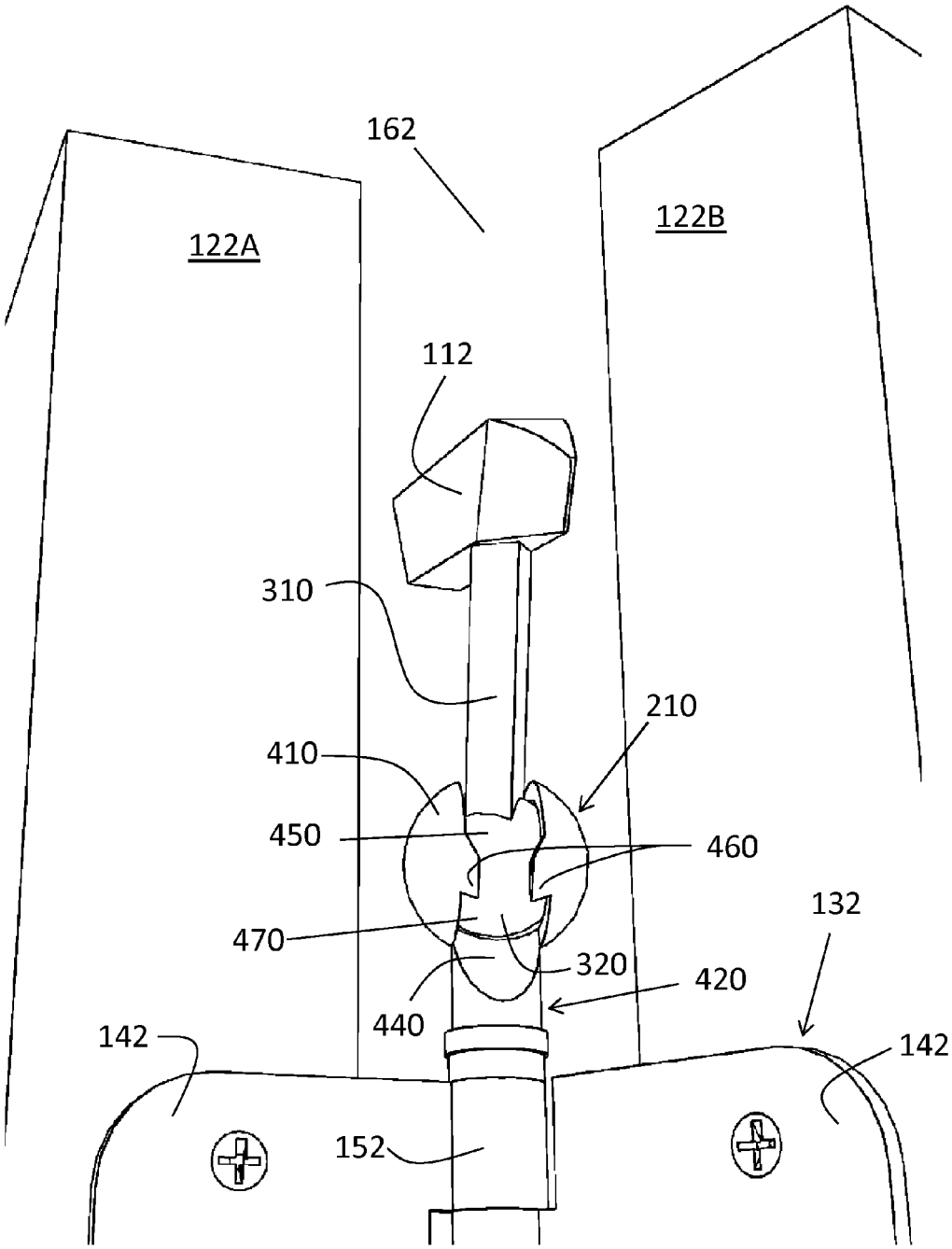

FIG. 5B illustrates how this embodiment enables the transition of chock 112 through gap 162. Ball-type joint 210 enables arm 310 to rotatably move along slot 450. Within said slot, ball-type joint 210 also allows arm 310 to rotate around its own axis, limited only by the width of said slot. Said slot is wide enough to allow arm 310 to rotate around its axis to better arrange chock 112 for transition through said gap.

This preferred embodiment enables arranging a chock into space between hinged surface 122A and hinged surface 122B along the closing path of hinged surface 122B, such an arrangement alone prevents hinged surface 122B from closing. This embodiment additionally enables arranging a properly designed chock in a configuration wider than a gap through which a chock transitions from a stowage position to a deployment position.

Figure 5C:
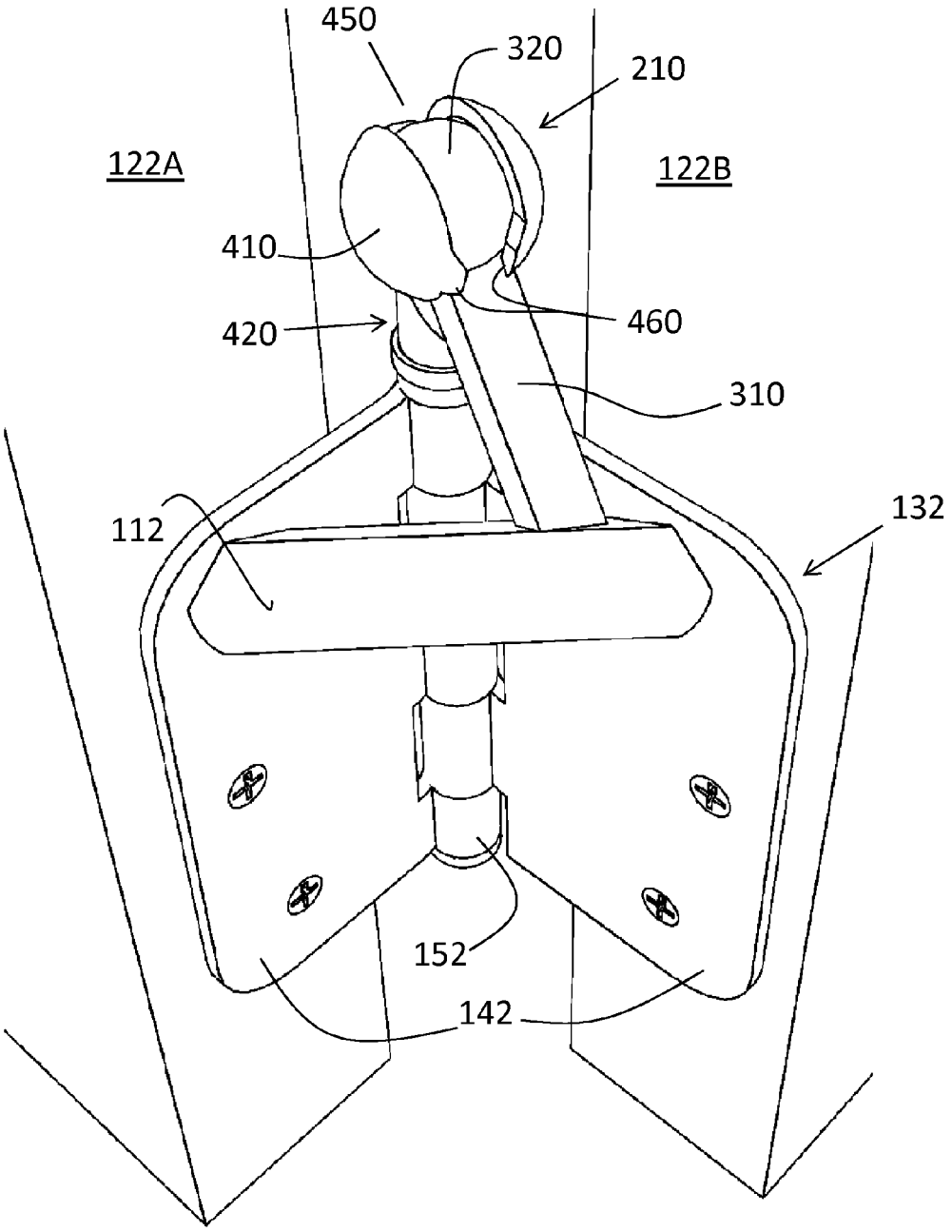

FIG. 5B serves best to describe how this embodiment of the invention enables arranging chock 112 in a widened deployed position, as shown in FIG. 5C. Ball-type joint 210 allows arm 310 to rotably move along slot 450 into opening 470; said opening being sufficiently wide not to limit rotation of arm 310 around its own axis. Within opening 470, chock 112 will contact the knuckle of hinge 132 before a full rotation of arm 310 can be completed, however, only a partial rotation is needed to properly deploy said chock in a widened arrangement. This preferred embodiment enables sufficient rotation to arrange said chock in a widened deployed arrangement by offsetting arm 310 to one side of chock 112.

FIG. 5C shows best that arm 310 is connected offset to one side of chock 112; in this configuration said chock has a long section to one side of arm 310 and a short section to the other side. Connecting chock 112 to arm 310 in this manner allows for said shorter section of chock 112 to clear knuckle 152 of hinge 132 when rotated into place and deployed widened. Due to said offset chock 112 is attached in a slightly skewed alignment with respect to arm 310.

FIG. 5C illustrates a preferred embodiment of the invention in a deployed position. Hinge 132 cannot fully close because chock 112 obstructs the closing movement. In this particular embodiment, chock 112, when in the deployed position, makes contact with the wings 142 of hinge 132. To reduce marring, it is preferable to obstruct movement of two hard surfaces, such as the wings of a hinge, yet it is obvious that other embodiments may interact with hinged surfaces 122A and 122B directly or against protective pads (not shown) placed on the points where a chock (of any design) would otherwise contact said surfaces.

In the deployed position shown in FIG. 5C, because arm 310 is not perpendicular to knuckle 152, a closing effort on hinged surface 122B will attempt to cause a movement of said arm towards the perpendicular. Locks, or stops, 460 prevent said movement by restraining arm 310. It will be evident to one skilled in the art that stops 460 are only one way to restrain arm 310 and alternative methods and stop designs need not be described.

This embodiment of the invention also enables stowage of chock 112 from a deployed position by following steps opposite from those to arrange chock 112 from a stowed position to a deployed position.

Referring once more to FIG. 5C, it is preferred that arm 310 holds chock 112, at a deployed position, closer to moving hinged surface 122B. The adjustments necessary to achieve the best offset of arm 310 for configurations different from what is shown in FIG. 5C will be evident to one skilled in the art.

A chock connected to this preferred embodiment may be repositioned between a stowed position and a deployed position in an elegant manner. A chock is no longer necessarily a provisional or portable propping apparatus. My invention may be left in place for as long as desired and a chock may be deployed quickly when needed and retracted and stowed when no longer required.

FIGS. 6A, 6B, 6C

Alternative Embodiments—Description and Operation

Figure 6A:
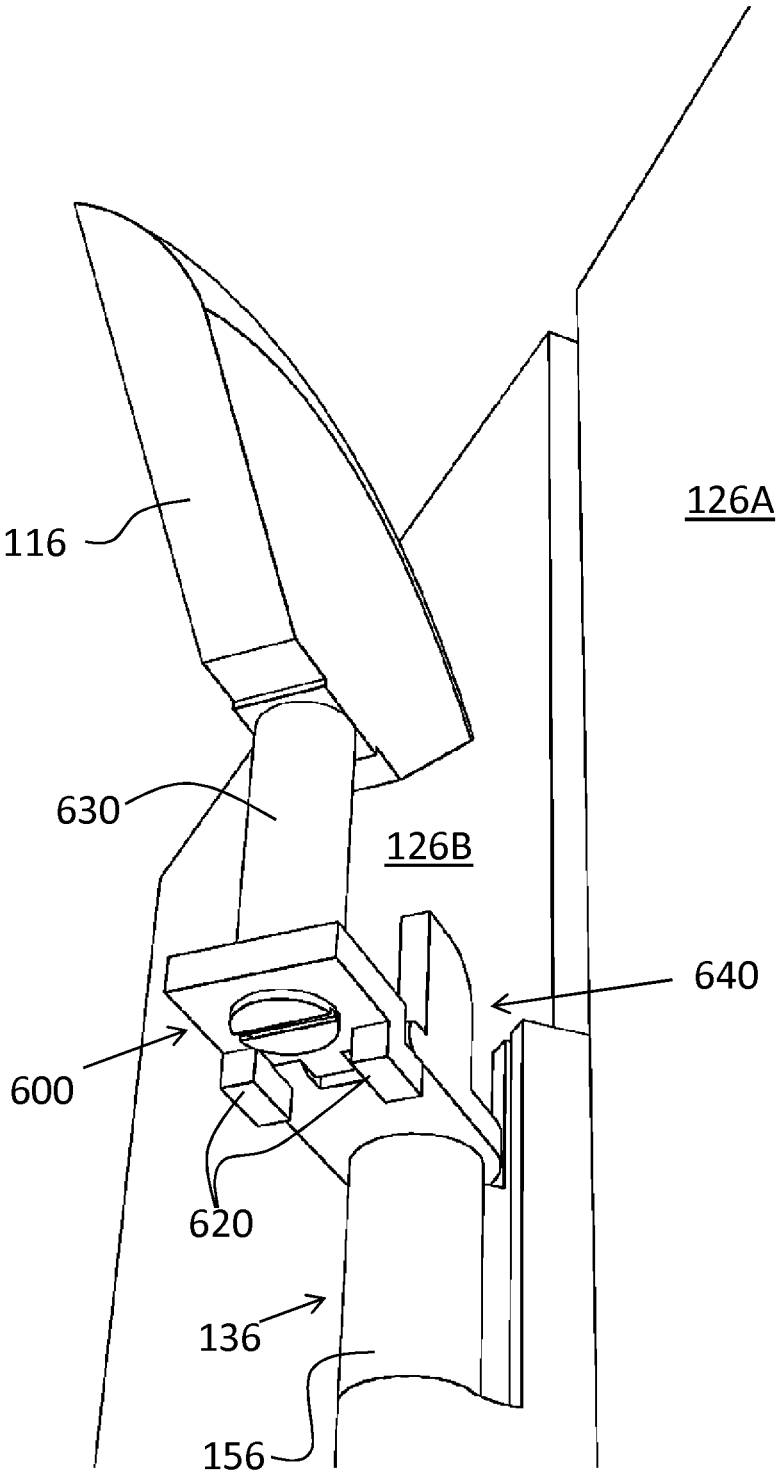
FIGS. 6A to 6C show a first alternate embodiment of the invention, and parts that interact with said embodiment, in arrangements between a stowage position and a deployment position.
Figure 6B:
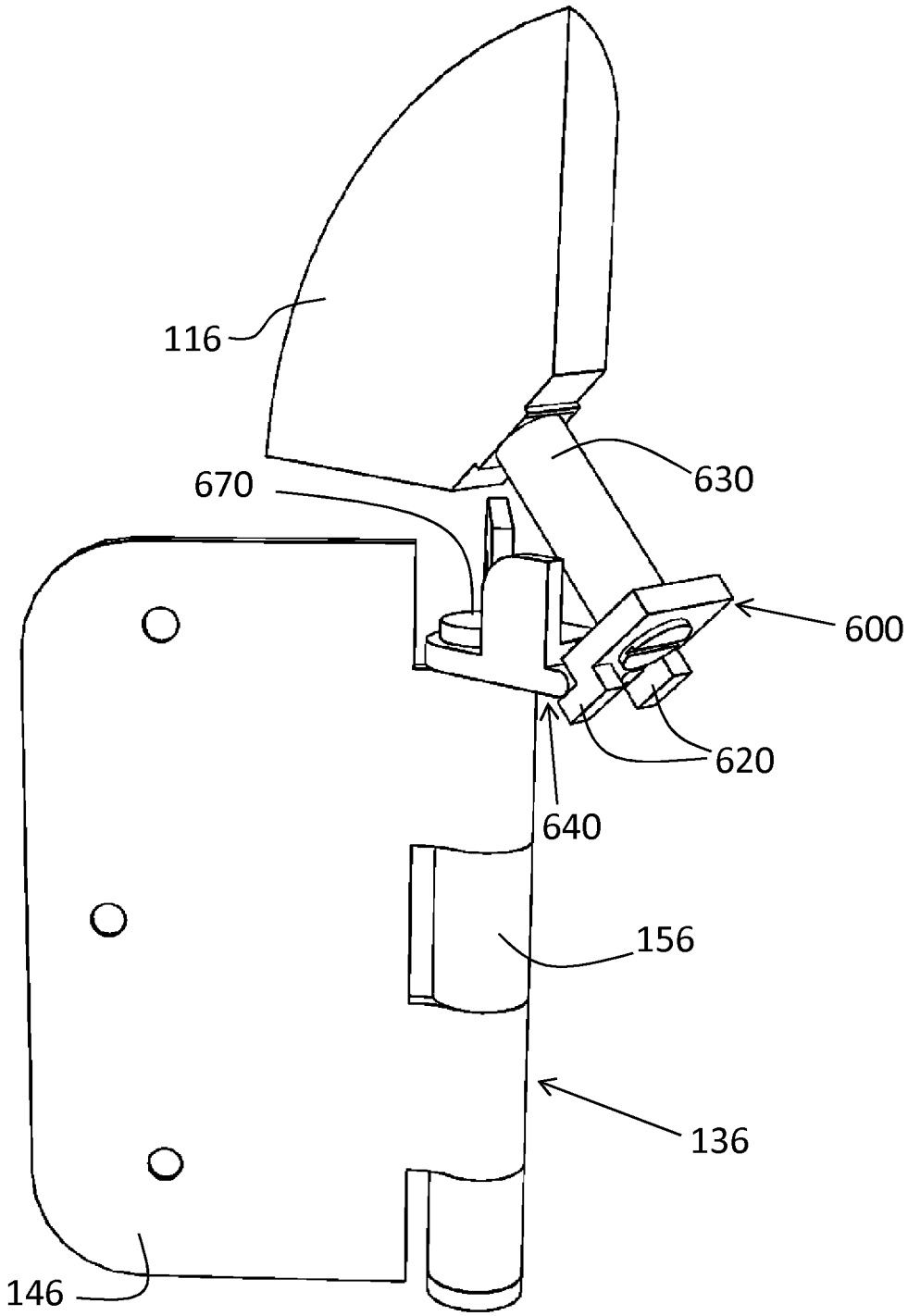
Figure 6C:
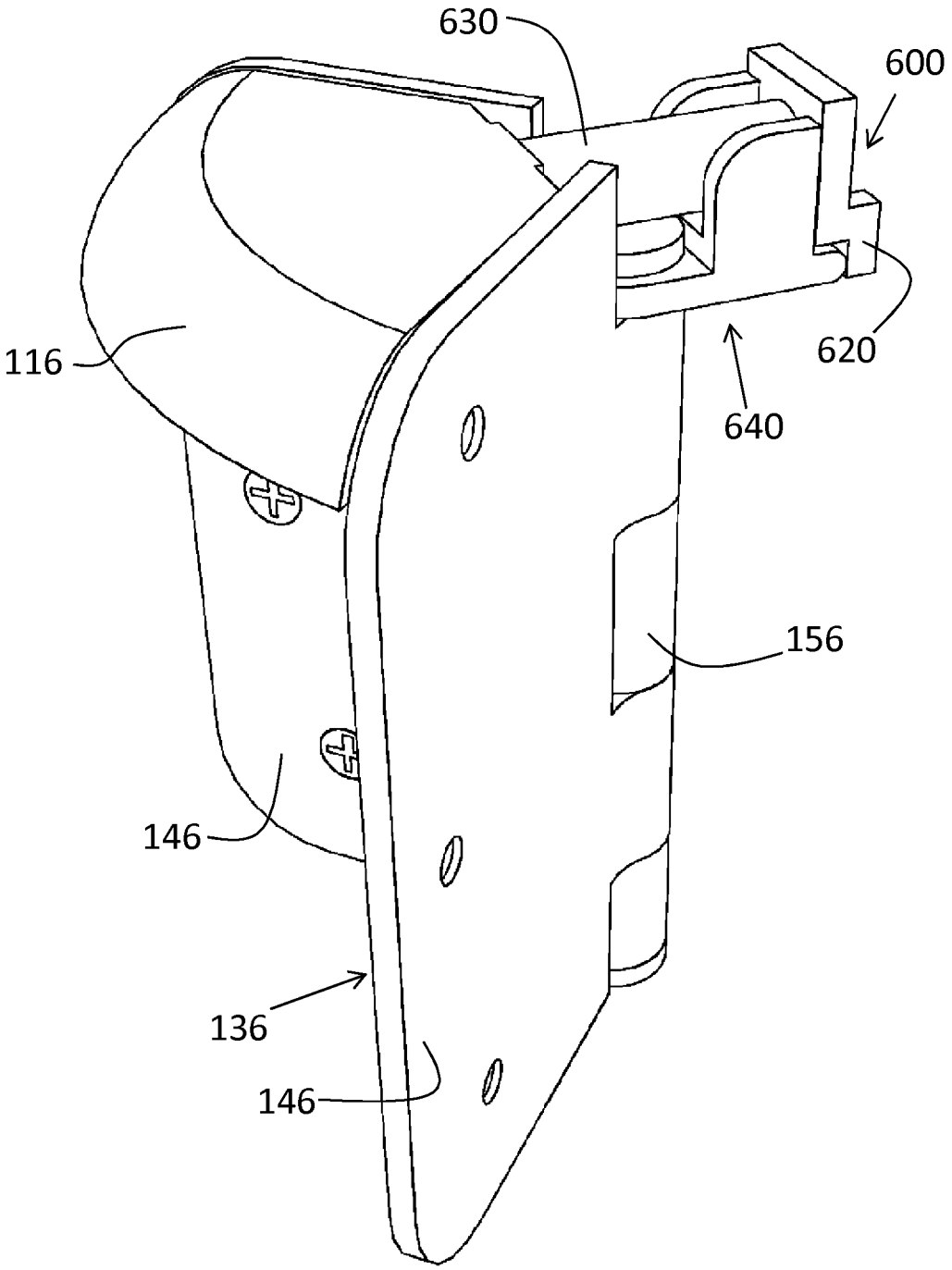

FIG. 6A to FIG. 6C illustrate an alternative embodiment of the invention and describe how said embodiment enables rearranging a chock between a stowed position and a deployed position.

Hinged surfaces, equivalent to hinged surfaces 120A and 120B of FIG. 1A to FIG. 1C, are shown in FIG. 6A only, and are identified as hinged surface 126A and hinged surface 126B respectively (only partially shown). Said surfaces have been purposely omitted from FIG. 6B and FIG. 6C as they are not required for an accurate description of this alternative embodiment and omitting said surfaces provides for better depiction of the views shown in the figures. If necessary, it should suffice to refer to FIG. 1B and FIG. 1C to understand the interactions with said surfaces.

Referring to FIG. 6A, a chock 116, equivalent to chock 110 of FIG. 1A, is shown in a stowed position. Said chock is attached to arm 630, which is rotatably coupled to pivoting base 600. Said pivoting base is then pivotally coupled to stationary base 640. Pivoting base 600 includes stops 620 to prevent it from overextending. This alternative embodiment of the invention thus enables stowage of chock 116. Said chock, in the shown position, is easily repositionable by reaching through a gap between hinged surfaces 126A and 126B when 126B is sufficiently open.

FIG. 6B shows how this alternative embodiment enables the transition of chock 116 between its stowed and deployed positions. It may also be noticed that knuckle 156 of hinge 136 has been modified to make it shorter than wings 146 of said hinge; the reason for this shall become apparent when reviewing FIG. 6C.

Because hinge 136 seems specifically designed for this alternative embodiment of the invention it may seem most appropriate to make stationary base 640 permanently attached to knuckle 156. The manner of attachment of said stationary base to said hinge does not limit the invention, even if said base were formed-as-one with hinge 136 or with one of said hinge's parts.

Just to establish a method of attachment for this embodiment we will consider that a pin 670 (only top shown) passes through a hole (not shown) on stationary base 640 and is then inserted into the knuckle of hinge 136. Such method of attachment has been used for door stops that prevent doors from over extending (U.S. Pat. No. 2,638,620 (1953) to Civitelli) and should be sufficiently familiar to one skilled in the art not to require further explanation or an additional drawing.

FIG. 6C shows hinge 116 arranged in a widened deployed arrangement, enabled by rotably coupling arm 630 to pivoting base 600.

FIGS. 7A, 7B, 7C

Alternative Embodiments—Description and Operation

Figure 7A:
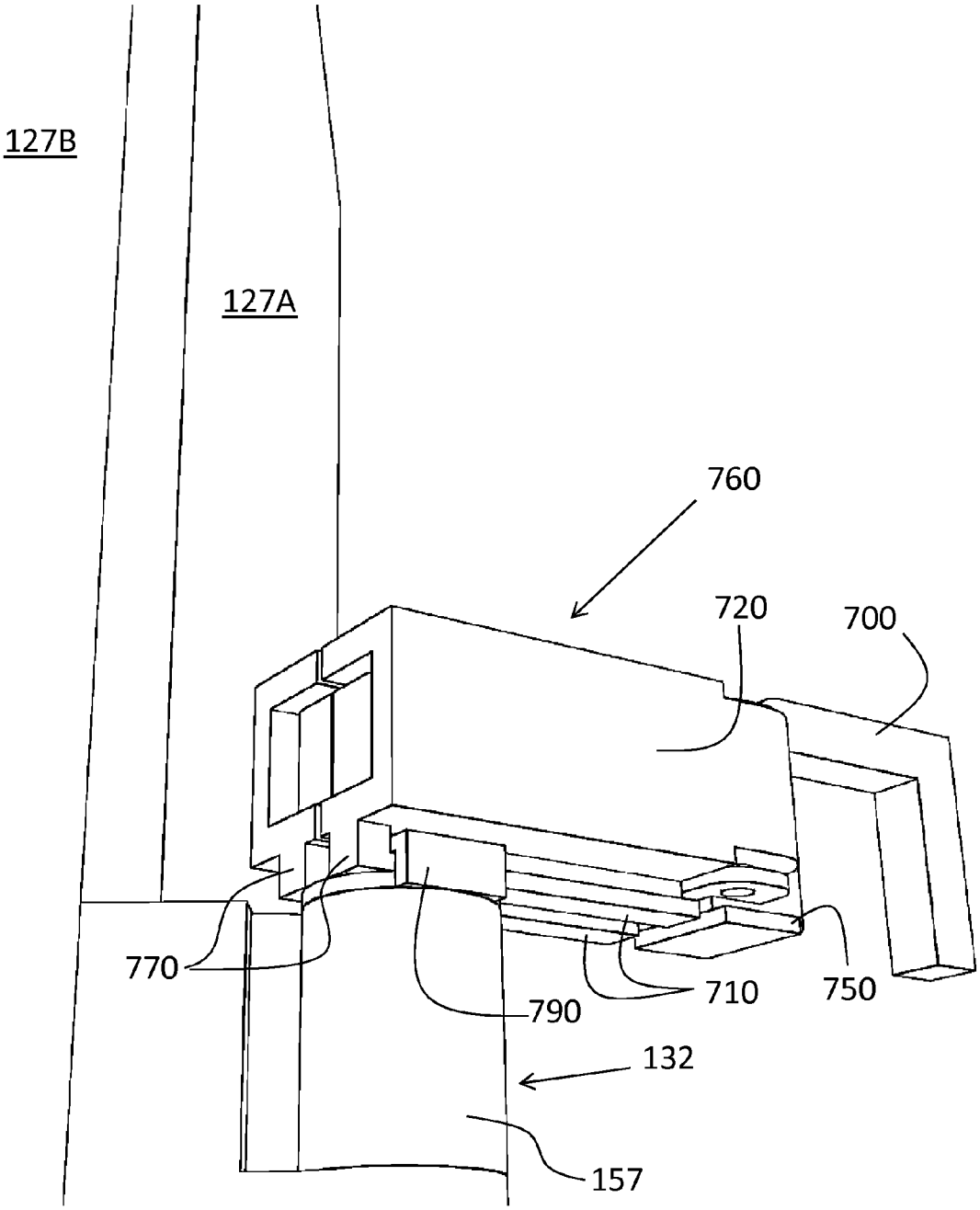
FIGS. 7A to 7C show a second alternate embodiment of the invention, and parts that interact with said embodiment, in arrangements between a stowage position and a deployment position.
Figure 7B:
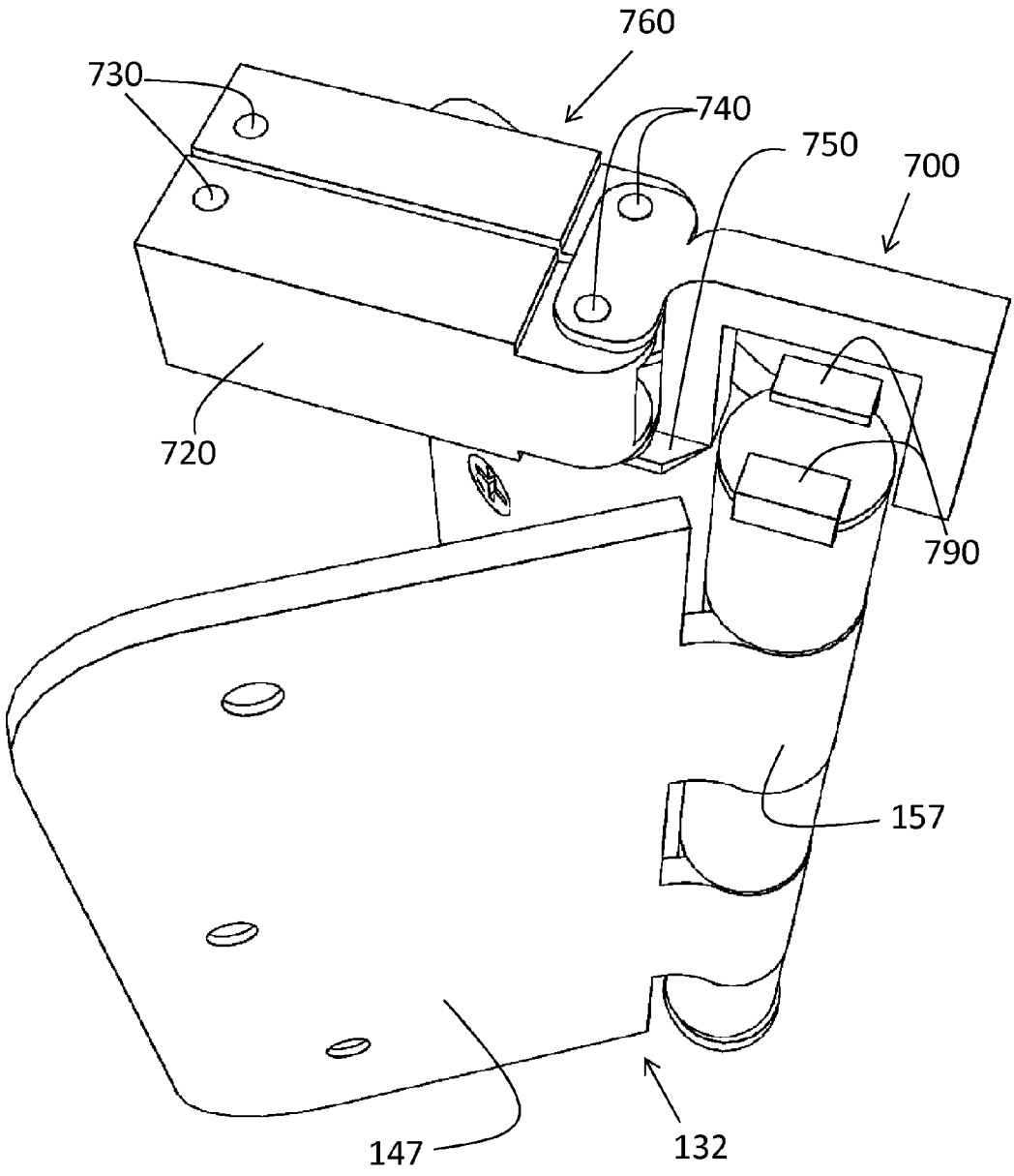
Figure 7C:
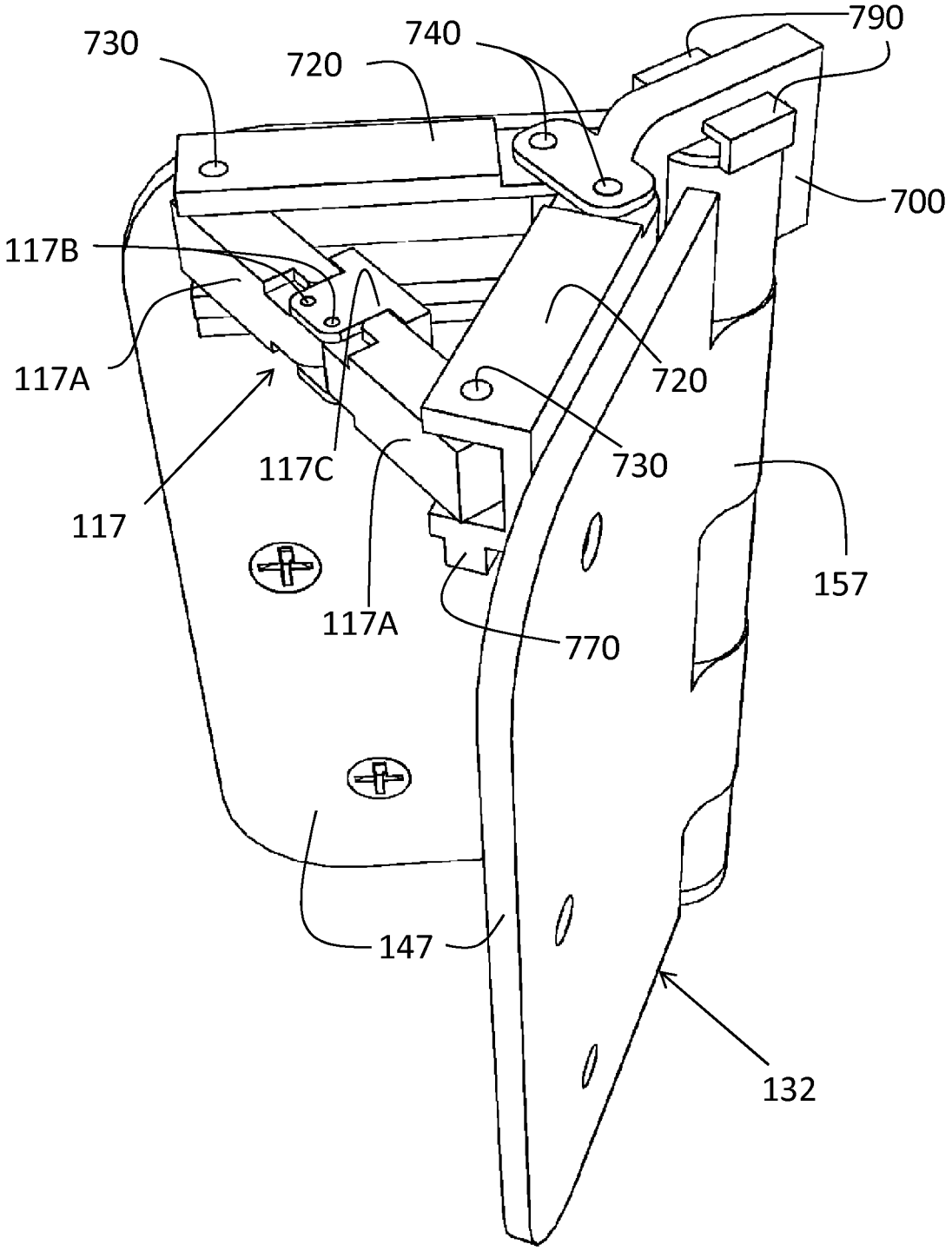

FIG. 7A to FIG. 7C illustrate an alternative embodiment of the invention and are useful to describe how said embodiment enables moving a chock between a stowed position and a deployed position.

Hinged surfaces, equivalent to hinged surfaces 120A and 120B of FIG. 1A to 1C, are shown in FIG. 7A only, and are identified as hinged surface 127A and hinged surface 127B respectively (only partially shown). Said surfaces have been purposely omitted from FIG. 7B and FIG. 7C as they are not required for an accurate description of this alternative embodiment and omitting said surfaces provides for better depiction of the views shown in the figures. If necessary, it should suffice to refer to FIG. 1B and FIG. 1C to understand the interactions with said surfaces.

FIG. 7A shows an apparatus resembling a linear guide attached at an end of knuckle 157 of hinge 132 (both only partially shown). FIG. 7A shows that said apparatus, which I will advance is an alternative embodiment of the invention, is comfortably out of the way of the closing path of hinged surface 127B. Using terms familiar to linear guides, FIG. 7A shows a carriage 760 with front guides 710 within rails 790 (only one shown). Carriage 760 can slide along rails 790 limited in one direction by stops 770. Rear guide 750, which aligns with guides 710, has no stops. In FIG. 7A a chock is not clearly shown and it is best to proceed to the following images and return to FIG. 7A once the embodiment is better understood.

FIG. 7B, equivalent to FIG. 1B, shows carriage 760 disconnected from rails 790 and freely moveable. Said carriage is shown to fit through a gap between hinged surface 127A and hinged surface 127B (said surfaces are not shown, but the position of wings 147 should make this clear). A chock is still not clearly seen in FIG. 7B and again it is best to continue to the following image and return to FIG. 7B once the embodiment is better understood.

FIG. 7C gives it all away. Base 700 rests at one end of knuckle 157 and carriage 760, shown in a open configuration, is held in place by a sufficiently snug fit of base 700 over said knuckle. FIG. 7C also shows that this embodiment enables deployment of chock 117 by opening arms 720. In this arrangement hinge 132 cannot fully close, and chock 117 is, thus, in the closing path of hinged surface 127B.

Chock 117 differs from other chocks described in other embodiments not only in appearance but also in the fact that it is not a monolithic part. A chock counters, or prevents, a closing effort on at least one hinged surface by occupying space it would need to transition in order to close. A different chock design has been purposely introduced in each of the embodiments to stress that the appearance and constitution of a chock is irrelevant as long as a chock properly interacts with an embodiment of the invention.

Figure 8:
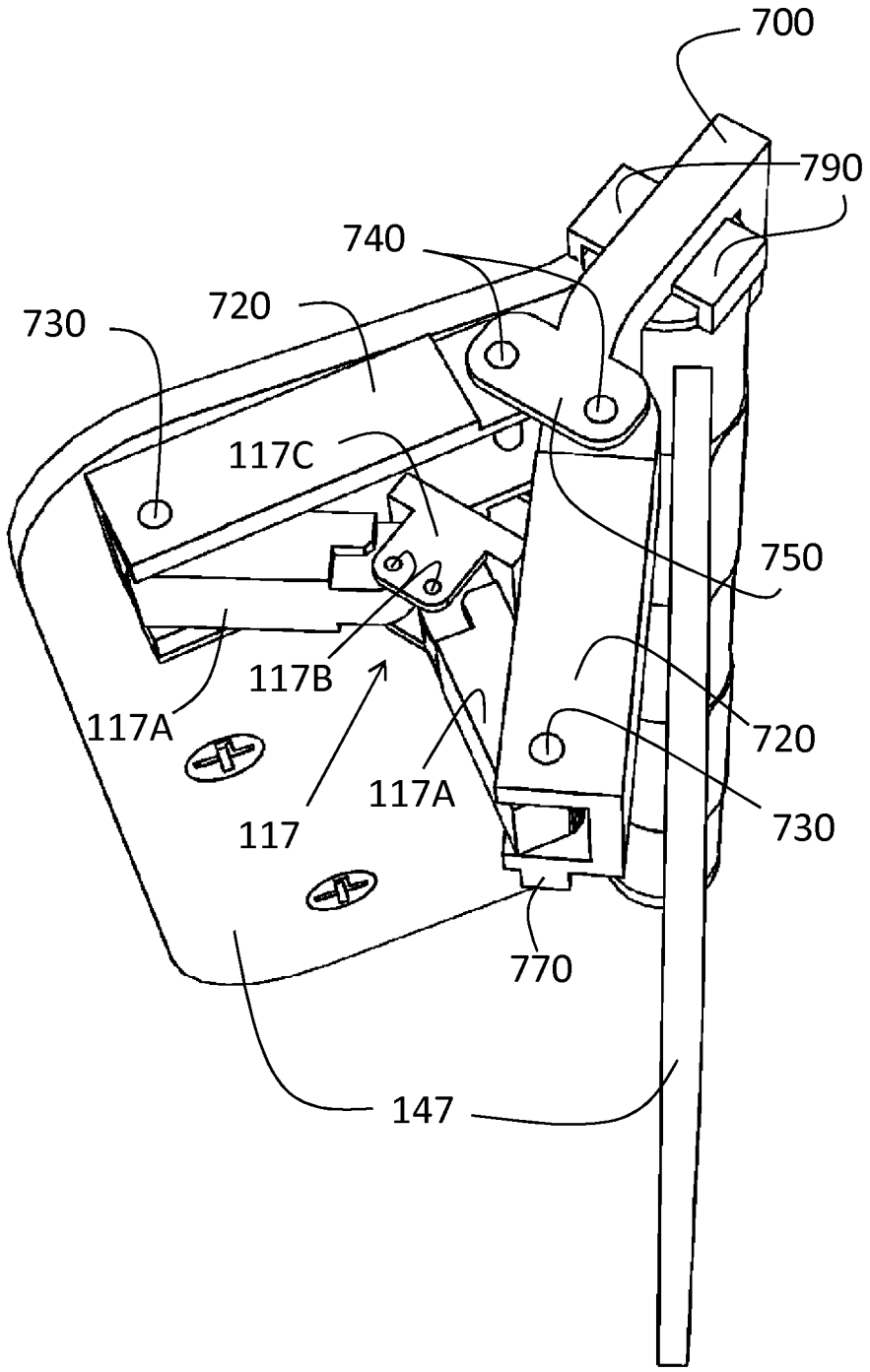
FIG. 8 shows said second alternate embodiment of the invention in an arrangement between those shown in FIGS. 7B and 7C.

In order to better understand how this embodiment of the invention enables the deployment of chock 117 it is best to refer to FIG. 8. Chock 117 is shown partially collapsed. This arrangement is a transition step between said chock's deployed and stowed position (in either direction). As arms 720 pivot around pins 740, chock arms 117A will pivot around pins 117B and pins 730. Coupler 117C connects chock arms 117A and also holds said arms in an extended arrangement at the deployed position.

It is now a good time to return to FIG. 7B. In this transition step between the deployed and stowed positions of chock 117, said chock is fully collapsed within arms 720 and is not visible. It has already been explained how carriage 760 can be set at an end of knuckle 157 to deploy chock 117. FIG. 7A also shows that carriage 760 can be moved such that rear guide 750 aligns with rails 790 (as shown in FIG. 7B); said alignment is required when it is desired to slide carriage 760 towards the stowage position of chock 117.

It will be evident to one skilled in the art that this embodiment of the invention can be modified so that carriage 760 cannot easily be removed, for example by adding a vertical stop to arm 700. This embodiment, however, offers multiple alternatives to the design of an embodiment of the invention, by introducing not only removable sections comprising an embodiment, but also a means of linear deployment as well as interaction with collapsible chocks.

Finally FIG. 7A is once more referenced. To achieve the arrangement shown in FIG. 7A, carriage 760 is slid on guides 710 along rail 790 (one guide not visible). In this manner this embodiment enables stowing chock 117 at a stowage position.

The means by which this embodiment is attached to enable stowing chock 117 at a stowage position is not obvious from the FIG. 7A. It will be clear to one skilled in the art that whichever means is selected has little influence on the performance of the embodiment. For sake of completeness it can be said that rails 790 have been formed-as-one with knuckle 132 by bending material extending above said knuckle to form said rails. Said means of attachment works well with this embodiment; a design with a removable section allows a manufacturer to supply hinges with discreet rails, similar to rails 790, onto which a removable part, like carriage 760, can selectively and easily be added.

CONCLUSIONS AND RAMIFICATIONS

Accordingly, the reader will see that my invention enables keeping a chock ready for use at a stowage position. When such time of use should arise, said chock can easily be deployed without the need to first locate it from a remote storage location. The invention will enable moving said chock through a gap between two hinged surfaces connected by at least one hinge. The invention may then further enable arranging said chock in a position such as to keep a hinged surface open at a wider angle.

Once a chock is no longer needed my invention can enable returning said chock to a stowed position where it may remain in place for future deployment. A chock is no longer, necessarily, a provisional or portable device; a chock may be left attached to my invention and stowed for as long as desired.

Some of the embodiments described herein can easily be detached and removed if no longer needed (depending on means of attachment), however there is no need to add terms as "portable", "removably attached" or "releasably secured" to my invention as the typical use would have this, once installed, most likely permanently in place.

Although the description contains many specificities, these should not be construed as limiting the scope of my invention but as merely providing illustrations of some of the presently preferred embodiments of the invention. Three embodiments were described herein, yet it will be almost immediately obvious to one skilled in the art that some features of one embodiment can be ported over to replace a similar feature of another embodiment, thus creating a "different" embodiment. For example: the ball type joint of the embodiment of FIG. 2 could be attached to a collapsing chock as shown in FIG. 8 and then be deployed on a hinge with shortened wings, as shown in the embodiment of FIG. 6C.

It should be clear that improvements to a chock, such as for example adding rubber sides to prevent marring or making a chock of a variable opening angle, have no effect on the scope the invention. It may seem to some, however, that a spring loaded embodiment where a chock is deployed with a push of a button (or automatically if a hinged surface is sufficiently open) is an improvement on my invention; this is nonetheless just another means of enabling moving a chock from a stowage position to a deployment position through a gap between them, and does not circumvent the scope of this invention.

It will now be readily apparent to those skilled in the art that there are numerous embodiments that will fit the scope of this invention; however none of those embodiments were apparent prior to the disclosure of this invention. This is, thus, the invention of all such embodiments.

I claim:

1. A method of selectively obstructing the hinged side of a hinged surface (hinged member) comprising:

a. providing a mechanism attached proximate a two-dimensional gap between a first hinged surface and a second hinged surface, wherein said first hinged surface and said second hinged surface are connected via a hinge, wherein said hinge includes a first wing and a second wing, wherein said mechanism is engaged with an end portion of said hinge, whereby said mechanism is designed to facilitate the movement of a chock between a first side and a second side of said gap, wherein a height of said gap is parallel to a line extending through the pivotal axis of said hinge, and wherein a width of said gap is defined as a distance between said first hinged surface and said second hinged surface at a point on said first hinged surface and a point on said second hinged surface most proximate to said pivotal axis;

b. pivoting said first hinged surface with respect to said second hinged surface to increase said width of said gap;

c. deploying said chock through said gap from said first side of said gap between said first hinged surface and said second hinged surface to a second side of said gap via pivoting an arm of said mechanism with respect to said end portion of said hinge, wherein said chock is engaged with a first end of said arm, wherein said chock will at least partially obstruct a closing movement between said first hinged surface and said second hinged surface by obstructing a corresponding closing movement between said first and second wings;

d. configuring said mechanism to selectively retain said arm such that said mechanism prevents a displacement of said chock due to a force causing said closing movement between said first and second wings, wherein said displacement of said chock is in a direction that is not perpendicular to said pivotal axis of said hinge;

e. retracting said chock by moving said chock through said gap from said second side to said first side, whereby said chock will be held by said mechanism and said chock will be stowed when not obstructing said closing movement between said first hinged surface and said second hinged surface.

2. The method of claim 1, further comprising arranging said chock so that, while deployed, said chock is in a configuration wider than said gap.

3. The method of claim 1 wherein said mechanism is further defined as having a pivot at a second end of said arm, wherein said pivot is configured such that said arm is pivotal with respect to said hinge.

4. The method of claim 3 wherein said pivot is further defined as comprising a bearing and a socket pivotally engaged with one another.

5. The method of claim 1 wherein said arm is further defined as having a bearing engaged with a second end of said arm, and wherein said second end of said arm is configured to pivot with respect to said hinge.

6. The method of claim 5 wherein said mechanism is further defined as comprising a socket, and wherein said socket is configured to pivotally engage said bearing.

7. The method of claim 6 wherein said socket further comprises a slot leading to an opening, wherein opposing stops are positioned between said slot and said opening.

8. The method of claim 7 wherein said opposing stops are further defined as being configured to selectively engage a portion of said arm.

9. The method of claim 8 wherein said mechanism is further defined as comprising a pin configured to engage said hinge and said socket.

10. The method of claim 9 wherein said mechanism is further defined as comprising a riser positioned between said pin and said socket.

11. The method of claim 1 wherein said mechanism is further defined as comprising a pin configured to engage said hinge.

12. The method of claim 11 wherein said arm is further defined as having a bearing engaged with a second end of said arm, and wherein said bearing is configured to pivotally engage a portion of said pin.

13. The method of claim 12 wherein said pin further comprises a socket formed thereon, wherein said second end of said arm engages said socket.

14. The method of claim 13 wherein said socket further comprises a slot leading to an opening, wherein opposing stops are positioned between said slot and said opening.

15. The method of claim 14 wherein said opposing stops are further defined as being configured to selectively engage a portion of said arm.

16. The method of claim 11 wherein said mechanism is further defined as comprising a riser engaged with said pin such that said riser extends upward above said hinge.

17. The method of claim 16 wherein said mechanism is further defined as comprising a socket engaged with said riser.

18. A method of selectively obstructing the hinged side of a hinged surface (hinged member) comprising:

a. providing a mechanism attached proximate a gap between a first hinged surface and a second hinged surface, wherein said first hinged surface and said second hinged surface are connected via a hinge, wherein said hinge includes a first wing and a second wing, wherein said mechanism is engaged with an end portion of said hinge, wherein said chock is engaged with a first end of an arm, whereby said mechanism is designed to facilitate the movement of a chock between a first side and a second side of said gap, wherein a height of said gap is parallel to a line extending through the pivotal axis of said hinge, and wherein a width of said gap is defined as a distance between said first hinged surface and said second hinged surface at a point on said first hinged surface and a point on said second hinged surface most proximate to said pivotal axis;

b. pivoting said first hinged surface with respect to said second hinged surface to increase said width of said gap;

c. deploying said chock through said gap from said first side of said gap between said first hinged surface and said second hinged surface to a second side of said gap via pivoting said arm with respect to said end portion of said hinge such that a portion of said chock passes through said line, wherein said chock will at least partially obstruct a closing movement between said first hinged surface and said second hinged surface, and wherein said portion of said chock is positioned between said first wing and said second wing;

d. configuring said mechanism to retain said arm so as to prevent a movement of said chock due a force causing said closing movement between said first and second hinged surfaces, wherein said movement of said chock is in a direction that is not perpendicular to said pivotal axis of said hinge;

e. retracting said chock by moving said chock through said gap from said second side to said first side such that said portion of said chock passes through said line, whereby said chock will be held by said mechanism and said chock will be stowed when not obstructing said closing movement between said first hinged surface and said second hinged surface.

19. The method of claim 18, further comprising arranging said chock so that, while deployed, said chock is in a configuration wider than said gap.

* * * * *